US005092459A

United States Patent [19]

Uljanic et al.

[11] Patent Number: 5,092,459

[45] Date of Patent: Mar. 3, 1992

[54] COVER FOR REMOTE CONTROL UNIT

[76] Inventors: Daniel Uljanic; Teresa L. Uljanic, both of 2824 D'Amico Dr., San Jose, Calif. 95148

[21] Appl. No.: 648,050

[22] Filed: Jan. 30, 1991

[51] Int. Cl.[5] ..... B65D 85/00; B65D 73/02; B65D 85/38; H01H 13/06

[52] U.S. Cl. ..... 206/320; 206/328; 206/305; 235/145 R; 200/302.2

[58] Field of Search ..... 206/305, 328, 320, 521, 206/214; 312/4, 138; 150/165; 229/141, 160.2, 198; 400/714, 472, 479, 479.1, 479.2, 477, 496; 235/145 R; 340/711; 200/302.1, 302.2, 304

[56] References Cited

U.S. PATENT DOCUMENTS

| | | | |
|---|---|---|---|
| 3,404,829 | 10/1968 | Stone | 229/141 |
| 4,006,764 | 2/1977 | Yamamoto et al. | 150/52 R |
| 4,259,568 | 3/1981 | Dynesen | 206/305 |
| 4,650,071 | 3/1987 | Grosshans | 206/214 |
| 4,703,160 | 10/1987 | Narishima et al. | 206/305 |
| 4,733,776 | 3/1988 | Ward | 206/305 |
| 4,762,227 | 8/1988 | Patterson | 206/305 |
| 4,836,256 | 6/1989 | Meliconi | 206/305 |
| 5,021,638 | 6/1991 | Nopper et al. | 235/145 R |

FOREIGN PATENT DOCUMENTS

| | | | |
|---|---|---|---|
| 2152437 | 8/1985 | United Kingdom | 400/496 |

*Primary Examiner*—Paul T. Sewell
*Assistant Examiner*—M. D. Patterson

[57] ABSTRACT

A transparent plastic case for encapsulation of a remote control unit having pushbuttons on its upper face, such that spilled liquid beverages cannot reach the pushbuttons to adversely affect operation of the control unit. The plastic case is openable to permit easy insertion of the control unit into the case.

1 Claim, 1 Drawing Sheet

COVER FOR REMOTE CONTROL UNIT

BACKGROUND AND SUMMARY OF THE INVENTION

This invention relates to a transparent case adapted to encapsulate a remote control unit for preventing liquids and foods from contacting the pushbuttons on the control unit, thereby becoming sticky or possibly inoperative.

Hand-held control units for television receivers or video cassette recorders commonly are provided with manually depressible pushbuttons. These pushbuttons extend through the wall of the control unit, leaving a small clearance crack between the side surface of each pushbutton and the edge of the associated hole in the control unit wall. People sometimes drink beverages or consume sandwiches while watching television programs. If the beverage should spill onto the hand-held controller, or if jelly from a sandwich should contact the controller surface, the liquid or food material could clog the pushbuttons and/or provide a sticky pushbutton surface. Controllers should not be immersed in water to clean the controller surfaces because the water could enter the controller through the cracks around the pushbuttons, thereby possibly degrading the performance of the control circuitry within the controller.

The present invention contemplates a transparent case structure to encapsulate a remote control unit so as to shield the pushbuttons from contact with foreign substances, especially liquid beverages or sticky foods. The case has a number of deflectable pads registerable with individual ones of the pushbuttons on the control unit, such that each pad can be individually depressed to operate the associated push button.

THE DRAWINGS

FIG. 1 is an enlarged sectional view taken on line 2—2 in FIG. 1.

DESCRIPTION OF A PREFERRED EMBODIMENT OF THE INVENTION

Figure 1:
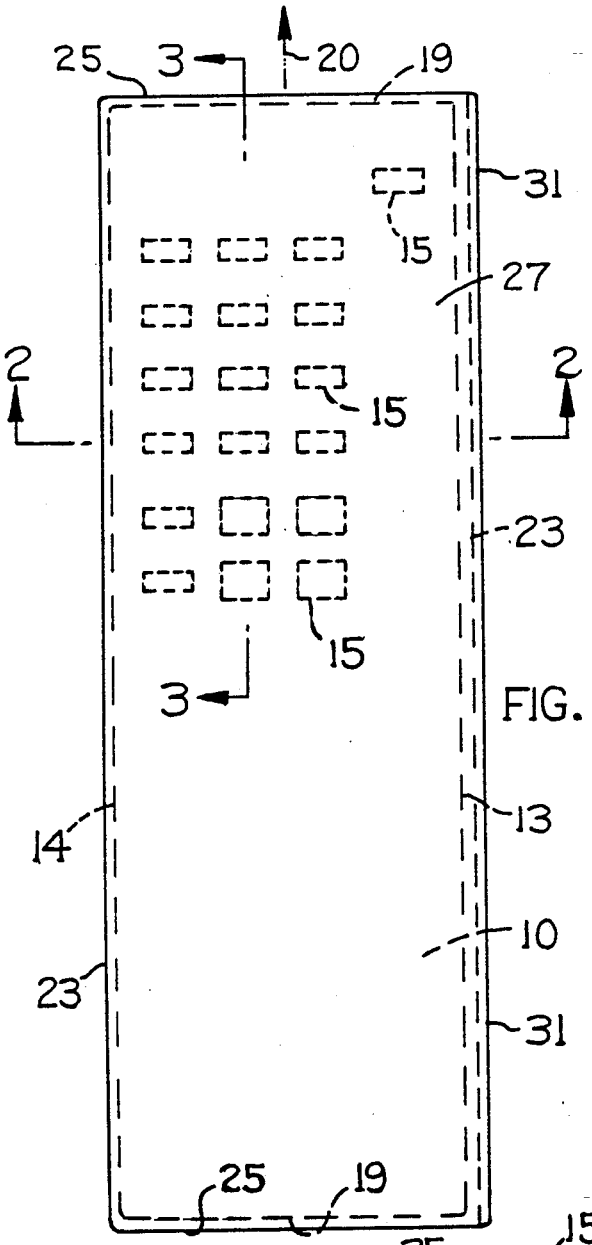
FIG. 1 is a top plan view of a plastic case structure embodying the invention.
Figure 3:
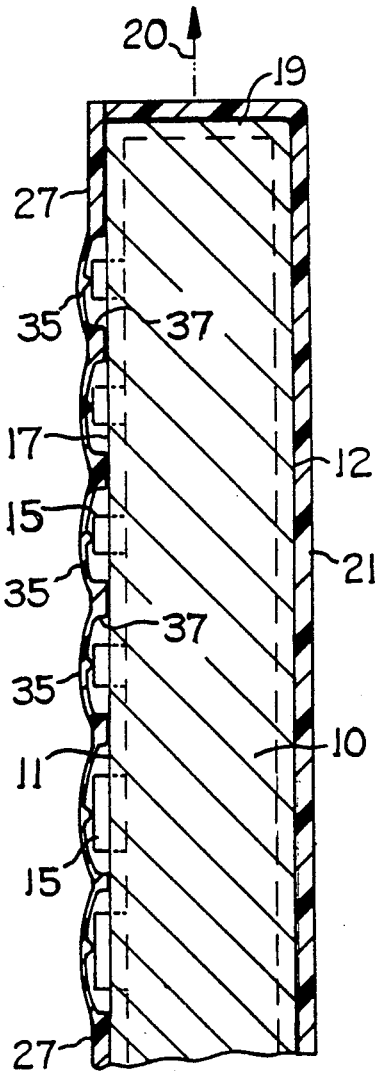
FIG. 3 is a fragmentary enlarged sectional view taken on line 3—3 in FIG. 1.
Figure 2:
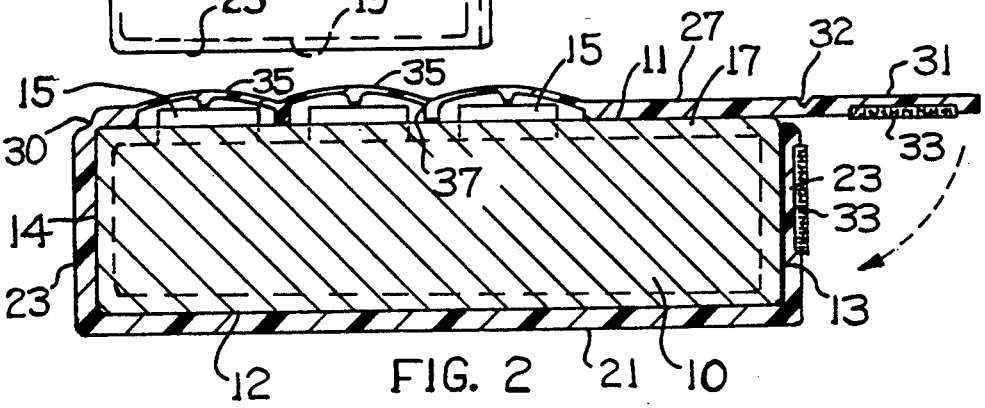

The drawings show a conventional hand-held remote control unit 10 for a television receiver or video cassette recorder. The control unit has an upper major face 11, a lower major face 12, and two longitudinal side edges 13 and 14. Pushbuttons 15 project upwardly through holes in the control unit top wall 17 for switching the circuitry within the control unit. A window is provided in wall 19 of the control unit for enabling a control beam to be directed from the control unit to the television receiver. Arrow 20 represents the control beam.

Each pushbutton usually projects from face 1 of the control unit a distance of approximately one sixteenth inch. The person normally holds the control unit in the palm of his/her hand with the pushbuttons facing upwardly, and with the fingers engaged against lower face 12 of the control unit. The person's thumb or first finger is moved along face 11 to select a pushbutton, and to depress the selected button. The person may or may not look at the control unit in order to select the appropriate pushbutton. In many instances the person uses the sense of touch to develop an understanding of the individual pushbutton locations, such that he/she is able to determine a desired pushbutton location simply by running the thumb or first finger across the upper face of the control unit. Each pushbutton is operated by depressing the button downwardly about one half its projected distance, e.g. about one thirty second inch.

The present invention relates to a transparent plastic case structure adapted to contain the remote control unit so that liquids or other foreign substances are prevented from contacting the pushbuttons. In the drawings the case structure is a rectangular box having a bottom wall 21, two upstanding side walls 23, and two upstanding end walls 25. A top panel 27 has a hinged connection 30 with the box whereby the box can be opened for placement of control unit 10 in the box. A flap 31 is hingedly attached to top panel 27 for disposition against the associated side wall 23; number 32 references the hinged connection between panel 27 and flap 31. Patches of adhesive fibrous material 33 are carried on the mating faces of flap 31 and box wall 23 for releasably holding the flap in a secure position on the box. Patches 33 can be formed out of adherent miniature hook and loop fibers, e.g. the material marketed under the tradename VELCRO.

Raised deflectable pads 35 are formed on top panel 27 for registration with individual ones of pushbuttons 15 when the control unit is placed in the transparent plastic box. Each pad is individually depressible for actuation of the associated pushbutton. The raised nature of each pad enables the person to locate a desired pushbutton by running his/her thumb or first finger along the upper (outer) surface of panel 27.

The panel has individual holes 37 therein aligned with pad 35 to fit around the pushbuttons. Holes 37 will be somewhat larger than the pushbuttons so that the pushbuttons can move freely up and down without restraint by the hole edges. The top panel preferably has a wall thickness that is approximately the same as the projection distance of each pushbutton (in the undeflected condition of the pushbutton). The wall thickness of each raised pad is less than the wall thickness of panel 27 to facilitate pad flexure.

The illustrated case structure is somewhat similar to a case structure shown in U.S. Pat. No. 4,836,256 to L. Meliconi. However, the Meliconi case structure does not have raised pads of the type shown herein; a person using the Meliconi structure would not be able to select a pushbutton by running his/her thumb along the case structure surface. There is also some danger that manual pressure on the Meliconi case structure surface would result in actuation of multiple pushbuttons, especially if the thumb pressure were not precisely centered on a single pushbutton.

The Meliconi case structure also lacks the hinged flap and adherent patch retention means shown in the present drawings. With our illustrated construction the case structure can readily be removed from the control unit and washed (if necessary).

The drawings necessarily show a particular embodiment of the invention. However, it will be appreciated that the invention can be practiced in various forms and configurations.

We claim:

1. A transparent plastic case structure for protecting a remote control unit, wherein the remote control unit has an upper major face, a series of pushbuttons projecting from said upper face, a lower major face, and two longitudinal side edges interconnecting said major faces: said case structure comprising a rectangular box having a bottom wall, upstanding side walls, a top panel having a first integral hinged connection with a first one of the box side walls so that the top panel is seatable on the upper face of the remote control unit with the unit is placed in the box, a flap having a second integral hinged connection with said top panel whereby the flap can be swung down from said top panel to engage a second one of the box side walls; and mating fibrous interlocking patches carried on said flap and said second one of the box side walls; said top panel having a thickness that is the same as the projection distance of each pushbutton so that when the top panel is seated on the upper face of the remote control unit the upper face of the top panel will be coplanar with the upper faces of the pushbuttons, said top panel having individual holes therein aligned with said pushbuttons to fit therearound; said top panel having a series of integral raised deflectable pads spanning the holes for registry with individual ones of the pushbuttons, each raised pad being individually depressible to operate the associated pushbutton; the wall thickness of each raised pad being substantially less than the wall thickness of the top panel to facilitate flexure of the pad toward or away from the associated pushbutton.

* * * * *